US005689844A

United States Patent [19]

Liu

[11] Patent Number: 5,689,844

[45] Date of Patent: Nov. 25, 1997

[54] PILLOW

[76] Inventor: Hsin-Cheng Liu, No. 10-2. Wu Lin St., Shu Lin Chen, Taipei Hsien, Taiwan

[21] Appl. No.: 790,337

[22] Filed: Jan. 28, 1997

[51] Int. Cl.[6] ..... A47G 9/02

[52] U.S. Cl. ..... 5/636; 5/645

[58] Field of Search ..... 5/636, 638, 640, 5/644, 645

[56] References Cited

U.S. PATENT DOCUMENTS

| | | | |
|---|---|---|---|
| 3,403,414 | 10/1968 | Unger | 5/636 |
| 3,411,164 | 11/1968 | Summergrade | 5/644 |
| 3,521,310 | 7/1970 | Greenawalt | 5/636 |
| 4,207,636 | 6/1980 | Ceriani | 5/636 X |
| 4,799,275 | 1/1989 | Sprague, Jr. | 5/636 X |
| 5,508,168 | 4/1996 | Byrne et al. | 5/636 |

FOREIGN PATENT DOCUMENTS

| | | |
|---|---|---|
| 79018 | 11/1985 | Taiwan . |
| 211121 | 10/1992 | Taiwan . |

*Primary Examiner*—Michael F. Trettel
*Attorney, Agent, or Firm*—Arthur F. Zobal

[57] ABSTRACT

This invention relates to an improved pillow having a multiple layer configuration. The pillow comprises an inner core, an intermediate layer and a surface layer. The inner core is integrally formed by three different materials each of which them has different elastic capability. The inner core has a corrugated outer surface. The inner core is further enclosed by an intermediate layer and is integrally formed by three different materials each of which them has different elastic capability. The intermediate layer has a smooth inner surface and a corrugated outer surface. The surface layer is made from son foam and has a smooth inner surface and a corrugated outer surface. By this arrangement, a supporting gradient is established in the resulting pillow. The pillow can be readily oriented to obtain suitable support for the head an neck portions to meet different requirements from the user. A plurality of air gaps are formed by the interference fit between the corrugated outer surface and smooth inner surface of two adjacent layers. When the pillow is compressed and released, the air trapped within the air gaps are squeezed and ventilated to provide an amiable contacting feeling to the head and neck portion. The resulting pillow can be cleaned and dehydrated by a washing machine without deforming. The resulting pillow can be readily packed by a vacuum process for storage and transportation.

2 Claims, 2 Drawing Sheets

PILLOW

BACKGROUND OF THE INVENTION

1. Field of the Invention

The present invention relates to a pillow, more particularly, to a pillow made from multiple layers of plastic material.

2. Description of the Prior Art

In our daily, lives, sleep takes about one third of our daily time each day. The pillow has a close contact with our head and neck portions during our sleep. The pillow plays an important role in whether that we may have a sound and sweet sleep or not.

The conventional pillow is stuffed with cotton which is incapable of washing for cleaning after a period of time. We can only expose the pillow under the sun for sterilizing and deodorizing by the ultra-violet. Nevertheless, exposing the pillow under the sunlight can not remove the scald and debris penetrated into the stuffed cotton. It is not good for health.

On the other hand, during the usage, the stuffed cotton is compressed and the elastic capability of stuffed cotton is lost gradually. Consequently, the comfortable support also is lost.

In Taiwan Utility Model Publication No. 79018, a "Portable Novel Pillow Configuration" is disclosed. In the '018 utility model, the inner core is configured with stuffed cotton made from polyester. Within the stuffed cotton, a cellular pocket having stuffed cotton is provided. This configuration can be a readily vacuum packed for reducing its bulk size which is advantageous in transportation, storage and sale. Eventhough the bulk size can be largely reduced during vacuum packing, it has a poor supporting effect since the cotton is over-compressed. On the other hand, the contacting area between the outer surface and the inner and outer polyester are parallel each other, and the polyester tends to accumulate in one side and be deformed as it is washed by a washing machine. The health problem is still pending and unsolved.

In Taiwan Utility Model Publication No. 211121, entitled "Multiply Pillow" there is provided a pillow which includes multiple layers made from chemical fibers and at least a foam layer. The upper and lower surfaces of the foam layer are provided with a plurality of projected bosses. By this arrangement, the contacting area between the foam layer and the chemical fiber layer is non-planar and an interface fit is established therebetween. By this arrangement, this pillow can be cleaned and dehydrated by a washing machine without deforming. Eventhough the resulted multiple pillow can be cleaned to solve the health problem it can be concluded with the following defects.

1. The inner core of the pillow is configured with multiple layers and a foam layer, therefore, there are too many elements and the pillow is costly to manufacture. On the other hand, once it is disassembled, it will be difficult to reassemble both by the maker and the user.

2. Since the inner core of the pillow is configured with multiple layers and a foam layer, the resulting corners are too sharp to provide a smooth appearance as well as comfortable support, as shown in FIGS. 5, 6, and 7 of the Taiwan Utility Model Publication No. 211121, and a large clearance will be generated when a cover is enveloped therearound. It may also have a plurality of pleats around the pillow. The appearance is largely negatively effected.

3. The stuffed polyester fiber layer, similar to cotton, is readily deformed when it is compressed for such a long period. On the other hand, the cotton layer is a simple polyurethane foam which has common elastic and soft capabilities. By this configuration, the resulting pillow has only one softness both on the upper and lower, front and rear, left and right sides. Accordingly, it has a limited supporting features resulting from one softness. On the other hand, the softness can not be adapted for different requirements.

4. As mentioned in the above paragraph, the resulted pillow has only one softness, nevertheless, when the head and neck portion are rested on the pillow, it has a curve contacting contour which needs different support in different sections. Nevertheless, the conventional pillow provides only one softness and can not meet this requirements.

SUMMARY OF THE INVENTION

It is the object of this invention to provide a pillow having multiple layers wherein the pillow made according to this invention comprises an inner core, an intermediate layer and a surface layer wherein each of the inner core and the intermediate layers is made from layers of different supporting capability. Each of the layers has a corrugated surface, accordingly, an interference fit is established between two adjacent layers. The resulting pillow can be readily oriented for different supporting capability. Accordingly, the head and neck portions may receive excellent support while an excellent ventilating effect may also be attained.

It is an object of the invention to provide a pillow wherein a soft surface layer, a high elastic layer, and a soft and middle elastic foam layer can be readily integrated for readily cleaning, dehydrating and drying without deforming. On the other hand, even for a long period of usage, the pillow is prevented from being compressed such that its soft and comfortable capability are not affected.

It is an object of this invention to provide a pillow which can be readily processed by vacuum packing to reduce its bulk size which is advantageous for transportation, storage and sale.

It is an object of this invention to provide a pillow wherein no cotton is used, accordingly, the resulting pillow can be readily cleaned. On the other hand, even for a long period of usage, the pillow is prevented from being compressed such that its soft and comfortable capability are not effected.

The pillow made according to this invention comprises an inner core, an intermediate layer and a surface layer wherein the inner core and the intermediate layers are made from high elastic foam material, soft foam material and middle soft foam material to establish a softness gradient thereof. The surface layer is made from soft foam material. The contacting portion of each of the multiple layers is configured with corrugated and smooth surfaces to provide a smooth contact with the skin. A plurality of air gaps are provided between two adjacent layers. By this provision, the user may select the best orientation for supporting his/her head and neck portions and a sound touching feeling. The pillow made according to this invention features durable, non-slip, easy to clean and readily vacuum packing capabilities.

DESCRIPTION OF THE PREFERRED EMBODIMENT

Figure 1:
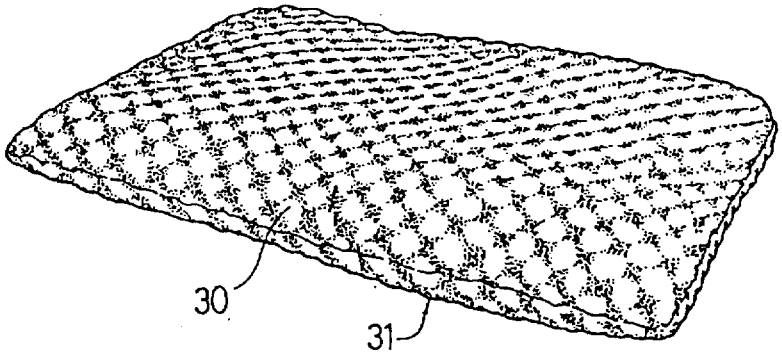
FIG. 1 is a perspective view of the pillow made according to this invention.
Figure 2:
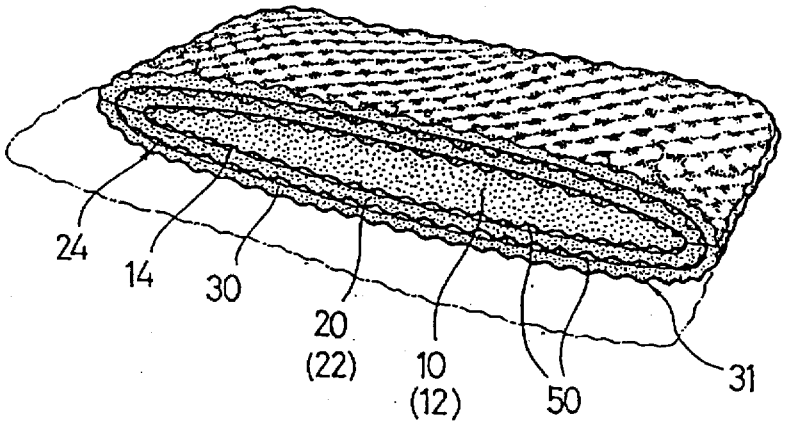
FIG. 2 is a cross-sectional view of the pillow of FIG. 1 taken along a longitudinal direction of the pillow.
Figure 3:
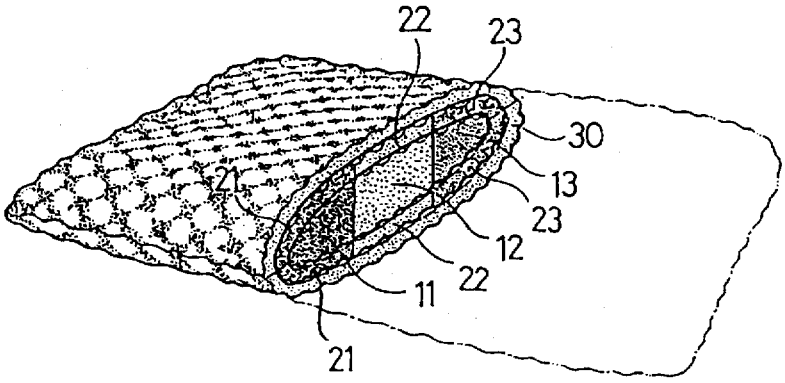
FIG. 3 is still a cross sectional view of the pillow of FIG. 1 taken along a transverse direction of the pillow.

Referring to FIGS. 1 to 3, the pillow made according to this invention generally comprises an inner core 10, an intermediate layer 20 and a surface layer 30.

The inner core 10 is integrally made from three different materials, i.e. high elastic foam 11, soft foam 12 (low elastic foam) and middle elastic foam 13. Each of the foams 11, 12 and 13 is disposed in parallel and adjacent with each other. Accordingly, a softness gradient is established in the transverse direction by the three different foam 11, 12 and 13. The inner core 10 has a corrugated ridge surface 14.

At least an intermediate layer 20 encloses the inner core 10. The intermediate layer 20 is also configurated with three different materials, i.e. the high elastic foam 21, soft foam 22 and middle elastic foam 23. The intermediate layer 20 has a planar or smooth inner surface and a corrugated outer surface 24.

A surface layer 30 encloses the intermediate layer 20 which envelopes the inner core 10. The surface layer 30 is made from soft material and has a planar or smooth inner surface and a corrugated outer surface 31.

By this arrangement, a pillow cover 40 can be removably located around the surface layer 30 of the resulting pillow. As disclosed above, each of two adjacent layers has an interference fit engagement by one of the corrugated outer surfaces 14, 24 and 31 and a planar or smooth inner surface. Accordingly, a plurality of air gaps 50 are attained between two adjacent layers.

Figure 4:
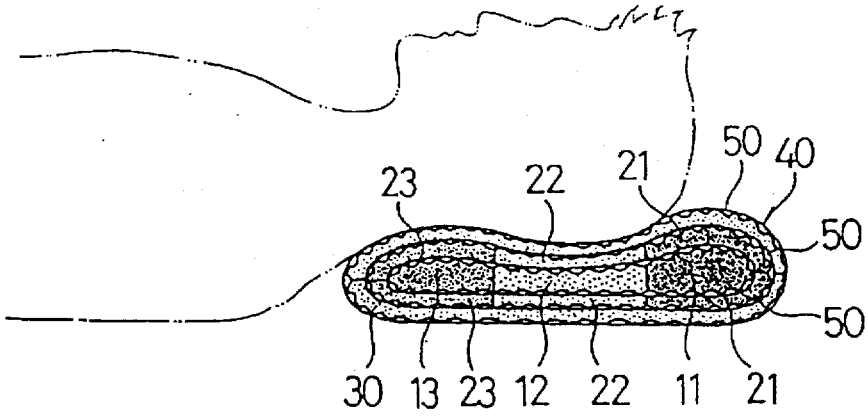
FIG. 4 is a schematic illustration showing the head and neck portions are well supported by the pillow made according to this invention when located in one position.

In application, the user may readily select a suitable orientation to receive an appropriate support for his or her head and neck portion. As shown in FIG. 4, the middle elastic foams 13, 23 can be disposed in the front position while the high elastic foams 11, 21 are disposed at the rear position and the soft foams 12, 22 are disposed therebetween. In this arrangement, the neck portion is in contact with the middle elastic foams, 13, 23 while the head portion is well supported by the soft foams 12, 22. Both of the head and neck portions can get an appropriate support with different foams.

Figure 5:
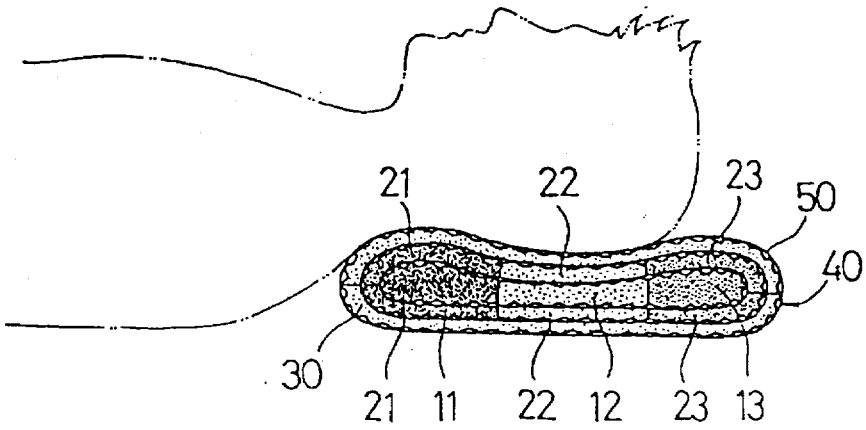
FIG. 5 is a schematic illustration showing the head and neck portions are well supported by the pillow made according to this invention when located in a position located opposite from that of FIG. 4.

As shown in FIG. 5, the pillow is oriented such that the middle elastic foams 13, 23 can be disposes in the rear position while the high elastic foams 11, 21 are disposed at front position and the soft foams 12, 22 are disposed therebetween. In this arrangement, the neck portion is in contact with the high elastic foams 11, 21 while the head portion is still well supported by the soft foams 12, 22. Again, both of the head and neck portions can receive an appropriate support with different foams. No matter how the pillow is made according to this invention is oriented, the user may receive sound and excellent support on both head and neck portions, especially since the outer contour of the pillow meets the contour of the head neck portions. Accordingly, the pillow made according to this invention provides a superior support over the conventional pillow.

On the other hand, a plurality of air gaps 50 are formed between two adjacent layers, and when the head rested on the pillow, is moved or rotated to different positions, the corresponding area of the pillow will be extended or compressed, accordingly, the air trapped within the air gap 50 is squeezed to ventilate. By this arrangement, an amiable feeling can be attained by the air gaps 50. No matter whether the user sleeps with face up, side or down, the contacted skin is well ventilated which facilitates one falling asleep.

The pillow made according to this invention can be readily cleaned by a washing machine without deforming. It can also be readily packed by a vacuum process to reduce its bulk size for storage, transportation. It is also portable for use anywhere.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

The formulation for the elastic materials for the pillow may be as follows:

| Formulations | High Elastic | Median Elastic Parts by weight | Low Elastic |
|---|---|---|---|
| PPG3000 (1) | 70 | 67 | 49 |
| TDI (2) | 28 | 29 | 41 |
| H2O | 1.7 | 2.0 | 2.9 |
| L-5305 (3) | 0.6 | 0.6 | 0.8 |
| S-26 (4) | 0.2 | 0.2 | 0.2 |
| MC (5) | 0.5 | 1.0 | 6.5 |
| Kaorizer (6) | 0–0.1 | 0–0.1 | 0–0.1 |

(1) Polymeric polyol commercially available from ARCO Chemical., LTD
(2) Toluene diisocyanate 80/20 commercially available from Bayer Co., LTD
(3) Surfactant commercially available from OSI specialties
(4) Catalyst commercially available from Witco Co., LTD
(5) methylene chloride
(6) Amine accelator

I claim:

1. A pillow having multiple layers comprising:

an inner core integrally made from three different materials, comprising high elastic foam, soft foam and middle elastic foam, said inner core having a corrugated ridge surface thereof;

at least an intermediate layer enclosing said inner core, said intermediate layer being made from three different materials, comprising high elastic foam, soft foam and middle elastic foam, said intermediate layer having a smooth inner surface and a corrugated outer surface; and a surface layer enclosing said intermediate layer which encloses said inner core, said surface layer being made from soft material and having a smooth inner surface and a corrugated outer surface;

wherein a plurality of air gaps are formed by the interference fit between said corrugated outer surface and smooth inner surface of two adjacent layers.

2. A pillow having multiple layers comprising:

an inner core comprising three integral layers of high elastic foam, soft foam and middle elastic form, said inner core having a corrugated ridge surface thereof;

said layers of high elastic foam and middle elastic foam of said inner core being spaced apart from each other with said soft foam layer being located between said layers of high elastic foam and middle elastic foam, at least an intermediate layer enclosing said inner core, said intermediate layer comprising three integral layers of high elastic foam, soft foam and middle elastic foam, said intermediate layer having a smooth inner surface and a corrugated outer surface;

said three integral layers of said intermediate layer being located such that said high elastic foam layer of said intermediate layer is located next to said high elastic foam layer of said inner core, said soft foam layer of said intermediate layer is located next to said soft foam layer of said inner core, and said middle elastic foam layer of said intermediate layer is located next to said middle elastic foam layer of said inner core, and a surface layer enclosing said intermediate layer, said surface layer being made from soft material and having a smooth inner surface and a corrugated outer surface;

wherein a plurality of air gaps are formed by the interference fit between said corrugated outer surface and planar inner surface of two adjacent layers.

* * * * *